US011770890B2

(12) United States Patent
Luiten et al.

(10) Patent No.: US 11,770,890 B2
(45) Date of Patent: Sep. 26, 2023

(54) TUNABLE SOURCE OF INTENSE, NARROWBAND, FULLY COHERENT, SOFT X-RAYS

(71) Applicant: Technische Universiteit Eindhoven, Eindhoven (NL)

(72) Inventors: Otger Jan Luiten, Eindhoven (NL); Jim Gerardus Hubertus Franssen, Grathem (NL)

(73) Assignee: Technische Universiteit Eindhoven, Eindhoven (NL)

( * ) Notice: Subject to any disclaimer, the term of this patent is extended or adjusted under 35 U.S.C. 154(b) by 312 days.

(21) Appl. No.: 17/289,632

(22) PCT Filed: Nov. 1, 2019

(86) PCT No.: PCT/EP2019/079968

§ 371 (c)(1),
(2) Date: Apr. 28, 2021

(87) PCT Pub. No.: WO2020/089454

PCT Pub. Date: May 7, 2020

(65) Prior Publication Data

US 2021/0400796 A1 Dec. 23, 2021

Related U.S. Application Data

(60) Provisional application No. 62/755,340, filed on Nov. 2, 2018.

(51) Int. Cl.
*H05G 2/00* (2006.01)
*H05H 7/02* (2006.01)

(52) U.S. Cl.
CPC ..... *H05G 2/006* (2013.01); *H05G 2/008* (2013.01); *H05H 7/02* (2013.01); *H05H 2007/025* (2013.01)

(58) Field of Classification Search
CPC ..... H05G 2/006; H05G 2/008; H05H 7/02; H05H 2007/025
See application file for complete search history.

(56) References Cited

U.S. PATENT DOCUMENTS

2018/0220518 A1 8/2018 Polyakov

OTHER PUBLICATIONS

Engelen et al. High-Coherence electron bunches produced by femtosecond photionization. Nature Communications 2013, pp. 1-5.

(Continued)

*Primary Examiner* — Nicole M Ippolito
*Assistant Examiner* — Hanway Chang
(74) *Attorney, Agent, or Firm* — LUMEN PATENT FIRM

(57) ABSTRACT

A device for generating soft x-rays includes an electron source configured to generate an electron beam comprising electron micro-bunches; an electron accelerator configured to accelerate the electron micro-bunches from the electron source; and a laser configured to generate a laser beam (536) colliding with the accelerated electron micro-bunches (534) in a counterpropagating direction to generate the soft x-rays by inverse Compton scattering. The electron source has a magneto-optical trap configured to produce an ultracold atomic gas; two counterpropagating excitation laser beams configured to produce a standing wave for inducing a periodic spatial modulation of the ultracold atomic gas along a beam propagation direction; and an ionization laser configured to induce photo-ionization of the ultracold atomic gas.

10 Claims, 7 Drawing Sheets

(56) References Cited

OTHER PUBLICATIONS

Shayeganrad. High resolution nanofocus X-ray source based on ultracold electrons from laser cooled-atoms. Cornell University Library 2018.
Franssen et al. From ultracold electrons to coherent soft x-rays. arxiv.org/pdf/1905.04031.pdf 2019.

TUNABLE SOURCE OF INTENSE, NARROWBAND, FULLY COHERENT, SOFT X-RAYS

FIELD OF THE INVENTION

The present invention relates generally to x-ray sources. More specifically, it relates to devices and methods for generating tunable, intense, narrowband, fully coherent, soft X-rays.

BACKGROUND OF THE INVENTION

X-ray methods are the most powerful non-destructive tools for analyzing matter. Electromagnetic radiation in the extreme ultraviolet (EUV) or soft x-ray spectral range (1-100 nm wavelengths or 0.01-1 keV photon energies) is rapidly gaining importance in both fundamental research and industrial applications.

However, successful application depends critically on the brilliance of the available sources. Currently, the degree of coherence and the average photon flux required by advanced applications is only available at large-scale synchrotron facilities and EUV Free Electron Lasers (FELs), severely limiting the range of applications.

SUMMARY OF THE INVENTION

In one aspect, the invention provides a compact, lab-sized and affordable soft X-ray source generating tunable, narrowband, fully coherent and intense soft X-ray photons, with a brilliance previously only provided by SLS and/or XFEL facilities.

The device combines an Ultra-Cold Electron Source (UCES) with an electron accelerator and a high-power laser in an Inverse-Compton-Scattering setup. The intense laser beam collides head-on with a counter propagating beam of electrons extracted from the ultra-cold electron source, travelling at a velocity close to the speed of light. Due to the relativistic Doppler effect the laser photons that bounce off the electrons are converted into (soft) X-ray photons, constituting a narrow (soft) X-ray beam travelling in the same direction as the electrons.

The electron pulses are created by a two-step photo-ionization process of an ultracold atomic gas, which enable precise tailoring of the initial electron density distribution in three dimensions. The initial longitudinal density distribution can be modulated by exciting the atoms using a standing wave of light. The excited atoms are then ionized to create a modulated electron distribution (micro-bunches), with a modulation period that is determined by the standing wave of light. The picosecond electron pulse is RF accelerated to a few MeV and simultaneously RF compressed by two orders of magnitude. This means that the modulation period is shrunk by the same two orders of magnitude. The modulation period is now equal to the wavelength of the soft x-ray pulse that is going to be generated. As a result the generated soft X-ray beam will be fully temporally coherent. In addition, the radiation generated by the individual micro bunches will add up coherently so that the intensity will be boosted by an amount proportional to the number of the electrons in the bunch. This boosts the intensity to intensities comparable to SLS and XFELs.

Simultaneously, the picosecond electron pulses extracted from the UCES source which are accelerated to a few MeV have an ultra-low electron temperature which means that the electron beam divergence is smaller than that of a diffraction limited soft X-ray beam; this guarantees the production of a fully spatially coherent soft X-ray beam.

Significantly, the device can generate tunable, narrowband (soft) X-ray beams which are fully coherent and have super-radiant intensity. This provides the realization of a table-top Compton soft X-ray free Electron Laser. This new type of table-top soft X-ray source has a performance in terms of brilliance, intensity and coherence vastly superior to all other compact sources, has many applications, in particular for wafer inspection in the semiconductor industry and high contrast imaging of biological samples in the 2-4 nm water window spectral regime.

At the present there is no alternative method to realize a fully coherent table-top soft X-ray free electron laser. The technique for extracting electrons from the ultra-fast ultra-cold electron source provides pre-bunching to reach longitudinal coherence and super-radiance, ultralow electron temperature (emittance) for transverse coherence. By combining spatial modulation of the photoionization process with radiofrequency bunch compression techniques, micro-bunching at EUV wavelengths and thus coherent amplification is realized.

The device may be used as an injector for an Inverse Compton Scattering (ICS) source. The high degree of coherence provided by the UCES allows the use of new, coherent regimes of ICS at EUV wavelengths. As a result, it has many important applications:

- The fully spatially coherent ICS source can produce a photon flux of $\geq 10^{12}$ photons/s at 12.5 nm, the wavelength corresponding to the Si-L edge, relevant for the semiconductor industry. This photon flux is sufficient for recording a nanometer resolution, high quality image in approximately one second. Diffractive imaging of a nanostructured material.
- The fully spatially coherent ICS source produces $\geq 10^{9}$ photons/s in the so-called 'water window', i.e. 2-4 nm, between the O-K edge and the C-K edge, relevant for high-contrast imaging with nanometer resolution of biological tissue.
- The source provides FEL operation at EUV wavelengths by ICS on pre-bunched electron beams from a UCES.
- The source achieves $10^{12}$-$10^{13}$ EUV photons per pulse, i.e. 10-100 μJ per pulse, by a fully coherent UCES-based ICS source. This enables single-shot illumination with fully coherent femtosecond EUV pulses, which previously could only be done at a few large-scale X-FEL facilities.

In one aspect, the invention provides a device for generating soft x-rays, the device comprising: an electron source configured to generate an electron beam comprising electron micro-bunches; an electron accelerator configured to accelerate the electron micro-bunches from the electron source; and a laser configured to generate a laser beam colliding with the accelerated electron micro-bunches in a counter-propagating direction to generate the soft x-rays; wherein the electron source comprises: a magneto-optical trap configured to produce an ultracold atomic gas; two counter-propagating excitation laser beams configured to produce a standing wave for inducing a periodic spatial modulation of the ultracold atomic gas along a beam propagation direction; an ionization laser configured to induce photo-ionization of the ultracold atomic gas.

Preferably, the electron accelerator comprises an RF compression cavity and X-band accelerator to simultaneously compress and accelerate the electron micro-bunches. Preferably, the electron accelerator comprises steering coils and a focusing magnetic coil. In some embodiments, wherein the electron accelerator comprises an RF compression cavity configured to operate in TM010 mode. In some embodiments, wherein the electron source comprises a DC plate configured to produce a DC acceleration field to extract the electron micro-bunches from the electron source.

In another aspect, the invention provides a method for generating soft x-rays, the method comprising: generating by an electron source an electron beam comprising electron micro- bunches; accelerating by an electron accelerator the electron micro-bunches from the electron source; and colliding a laser beam with the accelerated electron micro-bunches in a counter-propagating direction to generate the soft x-rays; wherein generating the electron beam comprising electron micro-bunches comprises: producing an ultracold atomic gas by a magneto-optical trap; producing a standing optical wave to induce a periodic spatial modulation of the ultracold atomic gas along a beam propagation direction; inducing photo-ionization of the ultracold atomic gas.

Preferably, wherein accelerating the electron micro-bunches comprises compressing the electron micro-bunches with an RF compression cavity and simultaneously accelerating the electron micro-bunches with an X-band accelerator. In some embodiments, wherein accelerating the electron micro-bunches comprises compressing the electron micro-bunches with an RF compression cavity operating in TM010 mode. Preferably, wherein generating the electron beam comprises extracting the electron micro-bunches from the electron source using a DC acceleration field. Preferably, wherein producing a standing optical wave to induce a periodic spatial modulation of the ultracold atomic gas along a beam propagation direction comprises inducing double-modulation.

DETAILED DESCRIPTION

An embodiment of the invention comprises an apparatus that entails the combination of an Ultra-Cold Electron Source (UCES) with an electron accelerator and a high-power laser in an Inverse-Compton-Scattering (ICS) setup. The intense laser beam collides head-on with a counter propagating beam of electrons extracted from the ultra-cold electron source, travelling at a velocity close to the speed of light. Due to the relativistic Doppler effect the laser photons that bounce off the electrons are converted into (soft) X-ray photons, constituting a narrow (soft) X-ray beam travelling in the same direction as the electrons. The implementation of the UCES as a source for ICS will lead to unprecedented soft x-ray coherence and brilliance. The electron pulses are created by a two-step photo-ionization process of an ultra-cold atomic gas, which enables precise tailoring of the initial electron density distribution in three dimensions. The initial longitudinal density distribution can be modulated by exciting the atoms using a standing wave of light.

Inverse Compton Scattering X-Ray Source

Figure 1:
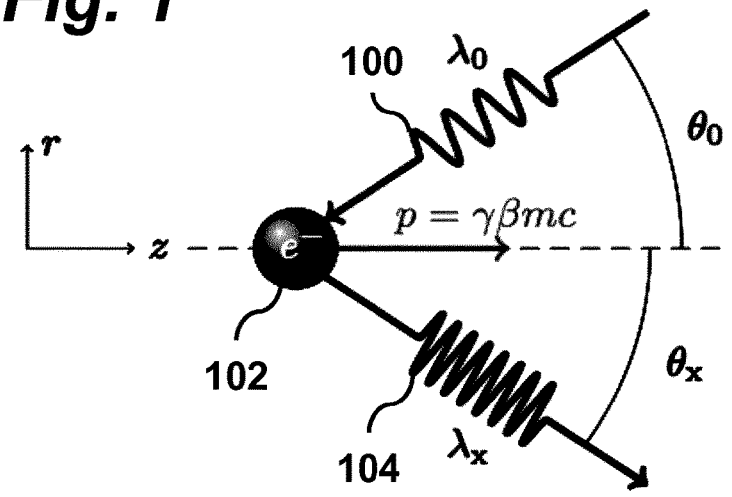
FIG. 1 is a schematic diagram illustrating an inverse Compton scattering process, according to an embodiment of the invention.

In the Inverse Compton Scattering (ICS) process light from an intense laser beam is bounced off a relativistic electron beam, turning it into a bright X-ray beam through the relativistic Doppler effect, as is schematically illustrated in FIG. 1.

If high power laser light 100 with wavelength $\lambda_0$, coming in at an angle $\theta_0$ with respect to an electron beam electron 102, is scattered into an angle $\theta_x$, then the wavelength of the scattered light 104 is given by:

$$\lambda_X=\lambda_0(1-\beta\cos\theta_X)/(1+\beta\cos\theta_0) \quad (1)$$

where $\beta=v/c$ is the velocity of the electrons normalized to the speed of light. For a head-on collision, i.e., $\theta_0=0$, with electrons moving at velocities close to the speed of light, i.e., $\beta\approx1$, Eq. (1) can be approximated by $$\lambda_X\approx\lambda_0(1+(\gamma\theta_X)^2)/4\gamma^2 \quad (2)$$

with $\gamma=(1-\beta^2)^{-1/2}$, the Lorentz factor of the relativistic electron beam. For example, for a laser wavelength $\lambda_0=500$ nm and a moderately relativistic electron beam with kinetic energy $U_{kin}=2$ MeV, i.e., $\beta=0.98$ and $\gamma=5$, soft X-rays will be generated at wavelengths as short as $\lambda_x=5$ nm. The X-rays will be emitted in a cone with a half angle of about $\gamma^{-1}$ centered around the direction of the electron beam, with the shortest wavelengths being generated in the forward direction ($\theta_X=0$) and progressively longer wavelengths for increasing O. The intrinsic narrowband nature of an ICS based source, combined with its high degree of directionality and the straightforward way in which the X-ray wavelength can be tuned continuously by simply changing the electron beam energy, make it a very attractive method for generating X-rays. Arguably it is the cleanest, purest and most controlled way of generating X-rays.

Unfortunately, however, the efficiency of the ICS process is very low. Assuming the electron beam waist is much smaller than the laser beam waist, the number of X-ray photons $N_x$ produced when a bunch of $N_e$ electrons collides with a laser pulse of $N_0$ photons is given by $$N_X=N_eN_0\sigma_T/2\pi w_0^2, \tag{3}$$

where $\sigma_\tau=6.65\times10^{-29}$ $m^2$ is the Thomson scattering cross section and $w_0$ is the waist of the laser beam. For example, if 500 nm, 100 mJ laser pulses are collided with 100 pC electron bunches at a repetition rate of 1 kHz in a laser beam waist $w_0=10$ μm, then an X-ray flux $\Phi_X\approx2\times10^{10}$ photons/s will be generated. This is an optimistic estimate, assuming state-of-the-art pulsed electron and laser beam technology, but it is still 2-3 orders of magnitude below the desired flux for advanced imaging applications. Moreover, the bandwidth will be large, as photons scattered at all angles are used in the estimate, and the spatial coherence of the generated soft X-ray beam will be very small, $<10^{-2}$ partial coherence, due to the inevitably large angular spread of the electron beam, associated with the finite emittance of a 100 pC bunch.

Spatially Coherent Compton Scattering

In order to generate a soft X-ray beam by ICS with full spatial coherence, first and foremost an electron beam with very high transverse quality is required. Transverse beam quality is usually expressed in terms of the geometrical emittance $\epsilon$, or focusability of the beam, expressed in units [m rad], which is equal to the product of beam size and uncorrelated angular spread. An electron beam can only generate a diffraction-limited, i.e. fully spatially coherent, X-ray beam if its emittance $\epsilon<\lambda_X/4\pi$. Since geometrical emittance depends on beam energy, it is convenient to define the normalized emittance $\epsilon_n=\gamma\beta\epsilon$, which is a Lorentz invariant measure for beam quality. In terms of the normalized emittance the coherence condition becomes:

$$\epsilon_n<\gamma\beta\lambda_X/4\pi. \tag{4}$$

By combining Eq. (1) with $\theta_0=\theta_X=0$ and Eq. (4) with an equality sign, we can calculate the minimum conditions necessary for spatially coherent ICS, resulting in the plot shown in FIG. 2.

Figure 2:
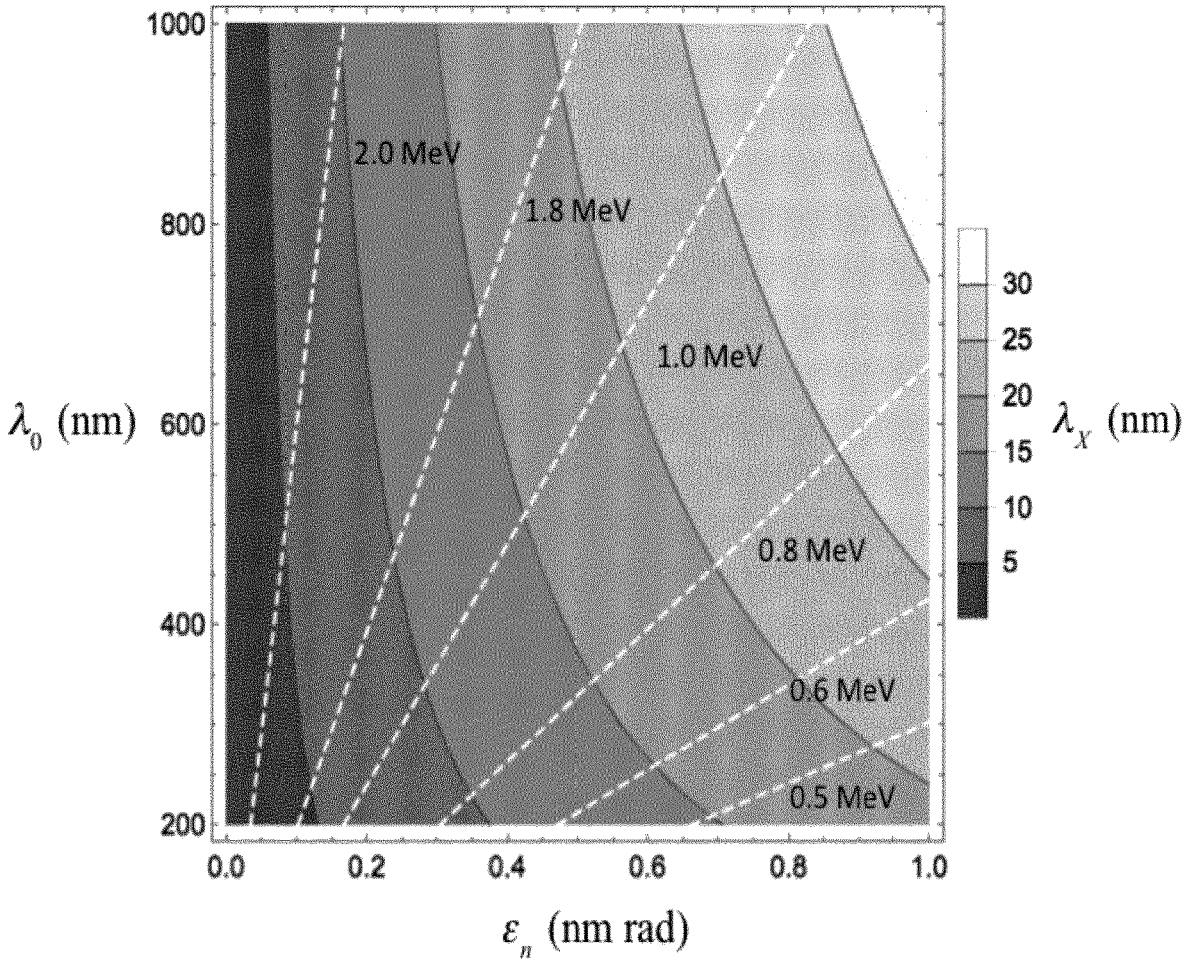
FIG. 2 is a graph illustrating EUV wavelengths $\lambda_X$ (gray scale) that can be generated by spatially coherent ICS for given $\lambda_0$ and $\varepsilon_n$, according to an embodiment of the invention. The corresponding electron beam energies are indicated by white dashed lines.

FIG. 2 shows the EUV wavelengths $\lambda_X$ that can be generated by spatially coherent ICS for a given laser wavelength $\lambda_0$ and normalized emittance $\epsilon_n$. The required electron beam energy is indicated by white dashed lines. For example, for $\lambda_0=500$ nm, $\epsilon_n=0.4$ nm rad, and 1 MeV beam energy, spatially coherent EUV radiation is generated with $\lambda_X=15$ nm. It is immediately clear from FIG. 2 that in order to generate coherent EUV radiation by ICS, high quality electron beams are required with normalized emittances preferably below 1 nm rad. Such beam qualities are usually associated with electron microscopy sources, which do not allow the generation of bunches with a lot of charge.

The Ultracold Electron Source

Figures 3A, 3B, 3C, 3D:
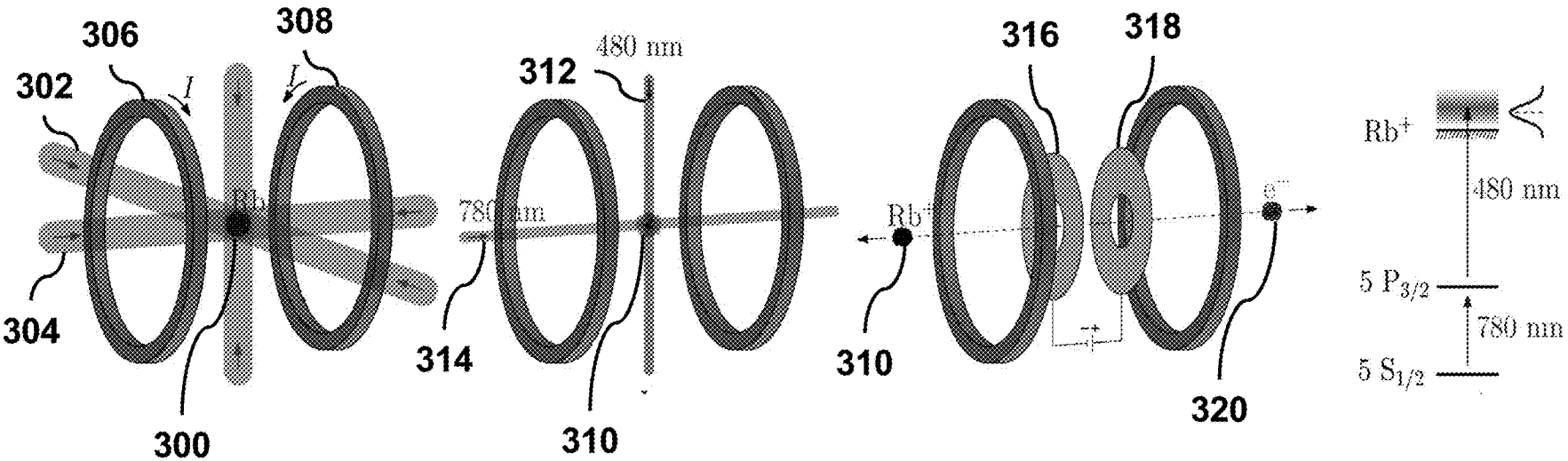
FIG. 3A, 3B, 3C illustrate steps of cooling, ionizing, and extracting performed by the electron source, according to an embodiment of the invention.
FIG. 3D is an energy level diagram illustrating a resonant two-photon photoionization scheme, according to an embodiment of the invention, with the 780 nm laser tuned to the $5P_{3/2}$ state. By varying the 480 nm laser wavelength, the excess energy of the electrons, and thus the electron temperature of the source, can be accurately controlled.

The UCES is based on ultracold atomic gas, usually rubidium vapor, which is cooled and trapped in a Magneto Optica Trap (MOT), and subsequently photoionized, using a two-step photoionization scheme, as is illustrated in FIG. 3A, 3B, 3C. Ultracold atoms are atoms that are maintained at temperatures close to 0 kelvin (absolute zero), typically several hundreds of microkelvin (μK).

FIG. 3A shows a Rubidium atom 300 laser-cooled and trapped in a MOT using perpendicular laser beams 302, 304 and coils 306, 308. Subsequently, after the cooling lasers are switched off, the laser-cooled Rubidium atom 300 is photoionized to produce a Rubidium ion 310 using a two-step photoionization scheme, employing the combination of a 780 nm excitation laser beam 314 and a 480 nm ionization laser beam 312, as shown in FIG. 3B. The ion 310 and electron 320 that are created in the volume where the two laser beams 312, 314 overlap are separated from each other and extracted with DC electric field plates 316, 318. Although just one pair is shown for purposes of illustration, many such ions and associated electrons are produced. The 780 nm excitation laser beam 314 is tuned to excite the $5P_{3/2}$ state of the atom, and the wavelength of the ionization laser beam 312 may be adjusted to precisely control the excess energy of the electrons, as illustrated in the energy level diagram of FIG. 3D. By varying the 480 nm laser wavelength, the excess energy of the electrons, and thus the electron temperature of the source, can be accurately controlled.

The UCES is characterized by electron temperatures as low as 10 K, 2-3 orders of magnitude lower than conventional photoemission sources, as was demonstrated first by nanosecond photoionization [2,3] and later by femtosecond photoionization as well [4,5]. As the normalized emittance of a source can be written as $$\epsilon_n=\sigma_s(kT_e/mc^2)^{1/2}, \tag{5}$$

where $\sigma_s$ is the root-mean-squared (RMS) transverse source size and $T_e$ is the source electron temperature, it is clear that the UCES allows much smaller normalized emittances than are possible with conventional photoemission sources. For example, for an RMS transverse size $\sigma_s=25$ μm and electron temperature $T_e=10$ K, the normalized emittance $\epsilon_n=1$ nm rad, a value that is routinely achieved with the UCES [4,5,6]. In a Rb MOT the size of the trapped gas cloud and thus the longitudinal size of the ionization volume is typically 1 mm and the densities can be as high as a few $10^{18}$ $m^{-3}$, implying that $N_e\approx10^6$-$10^7$ electrons can be created with $\epsilon_n=1$ nm rad. This combination of bunch charge and beam quality should enable, e.g., single-shot protein crystallography [3,6,7], which is one of the main driving forces behind the development of the UCES. Note that to achieve a similar normalized emittance from a conventional photocathode would require a source size $\sigma_s\leq1$ μm. To extract bunches with $10^6$ electrons from such a small spot would require unrealistic GV/m electric field strengths. The UCES however, allows even smaller emittances: by reducing the size of the overlap between the excitation and the ionization laser (FIG. 3B) to $\sigma_s=2.5$ μm, bunches containing $N_e\approx10^4$-$10^5$ electrons with $\epsilon_n=0.1$ nm rad can be created. It thus follows (see FIG. 2) that by using the UCES as an electron injector for an ICS source, fully spatially coherent radiation can be generated over the entire EUV spectral range. This is a unique property of the UCES and by itself more than enough reason to pursue this new approach. However, the amount of EUV photons generated with such bunches will be very modest (see Eq. (3)). Fortunately, the special characteristics of the UCES allow another trick to be played, which will both boost the photon yield enormously and take care of temporal coherence as well.

Microbunching and Superradiance

The resonant two-step photoionization process, employing the combination of an excitation laser, tuned to an intermediate atomic level, and an ionization laser, exciting atoms from the intermediate state to the continuum, allows very precise control of the initial density distribution of the ionized gas: since atoms are only ionized in the region where the two laser beams overlap, the initial electron bunch distribution can be accurately tailored in 3D by modulating the beam profiles of the two lasers. This was beautifully demonstrated by the Scholten group at the University of Melbourne, who used a Spatial Light Modulator (SLM) to shape the excitation laser beam and thus create electron bunches with intricate, almost arbitrary charge distributions, with the smallest sized structures only limited by the diffraction of the laser light [8]. The low temperature of the source turns out to be essential to maintain these intricate structures, which immediately get blurred due to random thermal motion of the electrons at higher source temperatures.

Figure 4:
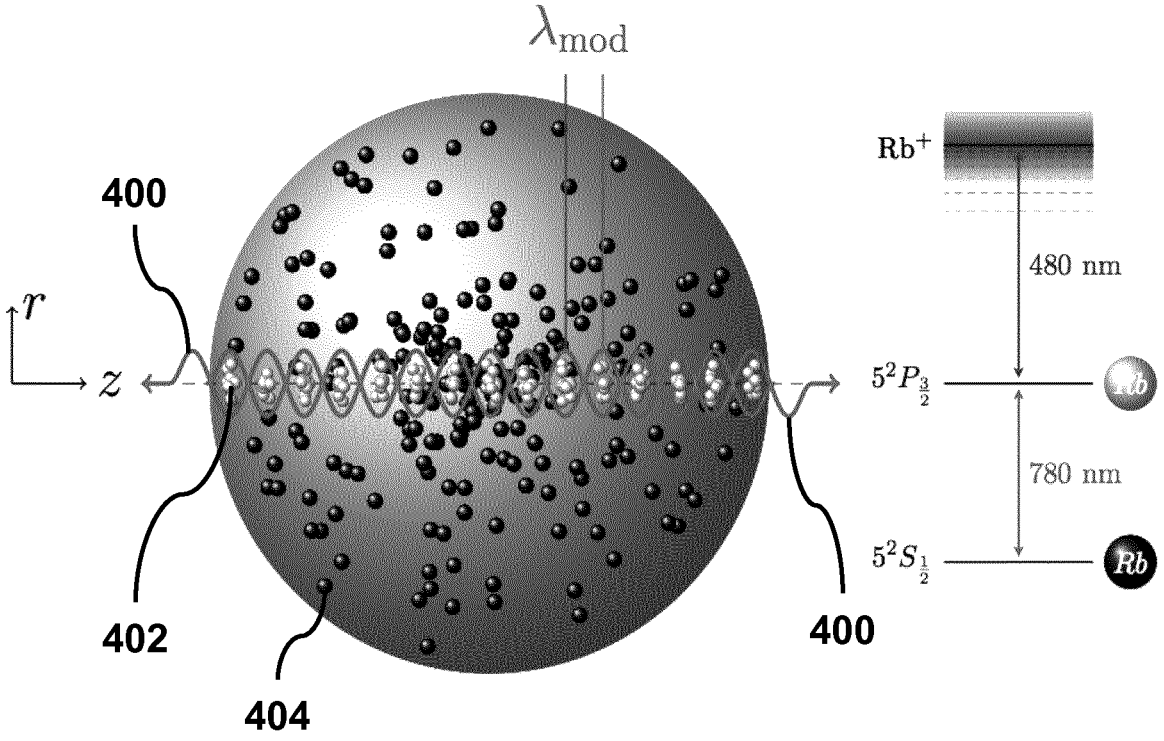
FIG. 4 is a schematic diagram illustrating a technique for spatial modulation of laser-cooled atoms, according to an embodiment of the invention.

Embodiments of the invention use an effective way to shape the initial charge distribution in a way extremely beneficial for boosting the ICS yield. As illustrated in FIG. 4, the excitation laser beam 400 includes two coherent counterpropagating laser beams (780 nm, in the case of Rb) which produce a standing wave pattern along the electron beam axis of the device. For example, a single beam can be split in two, with one beam sent in from the back and the other from the front, together creating a standing wave pattern. The accelerated electron beam can be magnetically deflected out of the incoming laser beam. Alternatively, one could retro-reflect the laser beam coming from the back on a mirror placed up stream in the path of the electron beam. A small hole in the mirror would transmit the electron beam, while minimally affecting the standing wave pattern. It should also be noted that the two counterpropagating laser beams creating the standing wave pattern need not be exactly counter-propagating; they may intersect at a small angle, provided their overlap is sufficient to create a standing wave pattern along a sufficient length of the beam axis in the MOT.

By using a 780 nm standing wave to excite the $5^2P_{3/2}$ state, the excited Rb atoms 402 in the MOT will be spatially modulated with a period of $\lambda_{mod}$=390 nm. The atoms 404 outside the standing wave 400 remain in their laser-cooled ground state. The periodic spatial modulation of excited atoms 402 are subsequently ionized by a femtosecond ionization laser (480 nm, in the case of Rb), aligned perpendicular to the excitation laser beam, thus almost instantly creating an electron bunch spatially modulated with a period equal to half the excitation laser wavelength, i.e., $\lambda_{mod}$=390 nm.

To generate EUV radiation by ICS, the electron bunch is accelerated to 0.5-2 MeV. This uses radiofrequency (RF) accelerator structures. A very compact accelerator structure operating at 12 GHz, in the so-called 'X-band', is used instead of the more conventional 3 GHz 'S-band' accelerating structures. Because of the high accelerating fields in the X-band accelerators, typically >50 MV/m, only 3 X-band cells, and thus less than 10 cm of accelerator structure is sufficient to cover the entire EUV spectral regime. Only acceleration, however, is not sufficient. In order to boost the ICS yield substantially coherent amplification is required. This can be accomplished by compressing the bunch in such a way that at the point where the accelerated bunch collides with the laser pulse, the period of the spatial modulation is decreased to the wavelength of the EUV radiation generated. For example, by accelerating a bunch with a normalized emittance $\epsilon_n$=0.4 nm rad to an energy of 1 MeV and colliding it with a 500 nm laser pulse, spatially coherent EUV radiation is generated at a wavelength of 15 nm (see FIG. 2). During initiation, the bunch is spatially modulated with a period equal to half the excitation laser wavelength, i.e. 390 nm, so during acceleration the bunch has to be compressed by a factor 26. As a result, the fields of the radiation emitted by the individual microbunches will add up in phase, thus coherently amplifying the EUV photon yield proportional to the bunch charge squared. Strictly speaking, coherent 'stimulated' emission is added to the incoherent 'spontaneous' emission, described by Eq. (2):

$$N_x=(1+FN_e)N_eN_0\sigma_T/2\pi_0^2. \quad (6)$$

Here $0 \le F \le 1$ is the form factor associated with the electron bunch distribution: in absence of any density modulation F=0, while F=1 for a bunch with a perfect periodic longitudinal density distribution. Here perfect means that the Fourier transform of the longitudinal density distribution only contains spatial frequency components associated with the EUV wavelength to be generated. For bunch charges of 0.1 pC, i.e., $N_e=6.2\times10^5$ electrons, colliding with 100 mJ, 512 nm laser pulses in a $w_0$=10 μm waist at a repetition rate of 1 kHz, the incoherent ICS photon flux (Eg. (2)) is $\Phi_X=1.7\times10^7$ ph/s. Assuming a perfect density modulation, the coherent photon flux is $\Phi_X=1.0\times10^{13}$ ph/s, more than sufficient for recording a full image. To obtain the same photon flux by incoherent ICS would require focusing a sub-ps, few MeV, 60 nC electron bunch to a spot smaller than 10 μm, which is not possible.

The coherent amplification of pulsed-electron-beam based radiation sources by this so-called superradiance mechanism is well known and has been applied times before. The challenge is always how to realize the required longitudinal density modulation, in the case of EUV radiation at the nanometer scale. Already in 1996 Carlsten et al. proposed to apply the density modulation in the transverse direction first, which can be done quite straightforwardly with a mask, and subsequently use a magnetic chicane to transfer it to the longitudinal direction [9]. The Graves group at MIT/ASU has recently devised a particularly smart variation of this method to actually realize nano-modulated electron beams and thus use superradiance to coherently amplify the soft X-ray photon yield in an ICS setup [10]. The UCES based method used here, has two major advantages: first, the two-step photoionization method allows extremely accurate shaping of the initial longitudinal bunch density distribution (see FIG. 4); second, the UCES based method provides full spatial coherence.

EUV Compton FEL

The combination of superradiant amplification of the emission by microbunching of the electron bunch and fully spatially coherent emission, constitutes the realization of a Free Electron Laser operating at EUV wavelengths, an EUV Compton FEL. The UCES-based EUV Compton FEL would have a footprint of only a few square meters, in stark contrast with present-day FEL facilities. Clearly, this would be an enormously important development allowing wide-spread dissemination of EUV FELs in academic and industrial labs and potentially even in semiconductor fabs.

Although in principle the UCES provides the ingredients necessary to realize full spatial coherence and superradiant emission, there are still major obstacles facing actual realization of a EUV Compton FEL. These obstacles can be summarized in a single, major challenge: the control of space charge forces. To achieve a large photon flux, as many electrons as possible should radiate in perfect unison, while confined in a very small volume, both focused transversely to a few μm, and compressed longitudinally to a few 10 μm (temporal compression to ~100 fs). The space charge forces associated with these high charge densities could cause deformation of the phase space distribution of the bunch, which could lead to irreversible emittance growth and thus loss of spatial coherence. Moreover, space charge forces could hamper bunch compression, leading to an imperfect bunch density modulation at the interaction point and thus reduced superradiance.

RF Compression by Velocity Bunching

Figure 5:
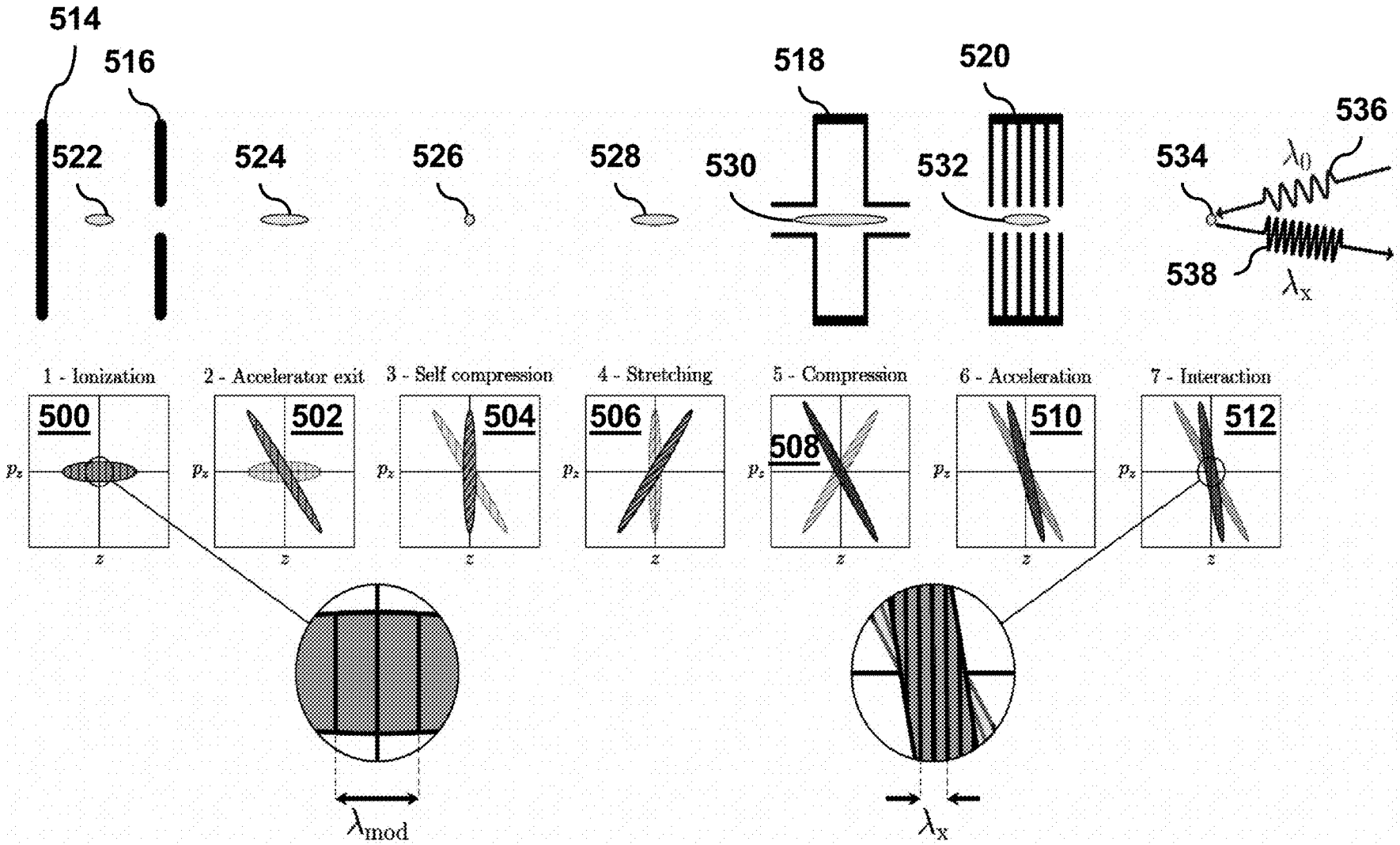
FIG. 5 is a schematic diagram of elements of an electron accelerator indicating the state of the beam at various points along the direction of propagation illustrating RF bunch compression, according to an embodiment of the invention.

In FIG. 5 the different longitudinal phase space distributions of a propagating electron bunch are shown in relation to components of a UCES-based ICS device. The device includes a sequence of elements coaxially aligned with a central electron beam propagation axis. In ionization step 500 an electron bunch 522 with a longitudinal periodic density modulation is created inside the grating-MOT-based UCES and extracted with DC plates 514, 516 that accelerate the bunches to a few 10 keV. Because the electrons created in the back of the bunch are accelerated over a larger distance, they acquire a larger kinetic energy and thus a higher velocity than those in the front of the bunch. In step 502, after exiting the DC accelerator the bunch 524 has acquired a negative energy chirp, leading to velocity bunching. In self-compression step 504, the bunch continues to propagate through a drift space until the bunch 526 reaches a self-compression point, where the electrons in the back of the bunch overtake those in the front. In stretching step 506, the propagating bunch experiences stretching to produce a bunch 528 with positive energy chirp. Completing its drift space propagation, in compression step 508 the bunch 530 enters and passes through a 3 GHz resonant RF compression cavity 518 in $TM_{010}$ mode, inverting the chirp, acquiring a strong negative chirp again, leading to bunch compression by velocity bunching in the drift space behind the RF cavity. In acceleration step 510, the bunch 532 then enters and passes through a 12 GHz x-band accelerator 520, boosting the average bunch energy to a desired energy. After exiting the X-band accelerator, the bunches compress as they propagate. Just before maximum compression, exactly at the point where the density modulation is properly lined up again, the bunches reach an interaction point. In interaction step 512 the accelerated bunch 534 collides at the interaction point with counter-propagating high-power laser beam 536 to produce soft x-rays 538.

Further Exploitation of the Initial Longitudinal Density Modulation

In other embodiments, the periodic spatial modulation in the MOT may be accomplished in the ground state gas by using the dipole force in the standing wave of two counter propagating laser beams at a wavelength far-detuned to the blue with respect to the transition to the intermediate state. In fact, this could be a superior method, since it would entail compressing the atoms prior to excitation, thus leading to higher initial bunch densities.

Interestingly, by combining the standing waves of the excitation laser and a 'dipole force' laser, a multi-periodic modulation would result, which would include structures at the scale of the difference of the two wavelengths, possibly much smaller than the diffraction limit at optical wavelengths. This could be useful when considering the possibility of using the UCES for realizing coherent amplification of hard X-rays. In addition, this would open the possibility of coherent amplification at two wavelengths simultaneously, and thus two-color operation at EUV wavelengths. To realize this, a doubly modulated bunch would collide with two laser pulses at different wavelengths. The normalized emittance, beam energy and laser wavelengths can be read off from FIG. 2. To give an example: by having a properly doubly modulated electron bunch with a normalized emittance of 0.4 nm rad and accelerated to 0.8 MeV, collide with both a 500 nm laser pulse and a 300 nm laser pulse, fully coherent and coherently amplified EUV radiation both at 22 nm and 13 nm would be generated. Clearly, the two-step photoionization method and the use of the dipole force, possibly combined with Spatial Light Modulators (SLMs), allow intricate ways for very precise and flexible tailoring of the density distribution, leading to new applications.

The Setup

Figure 6:
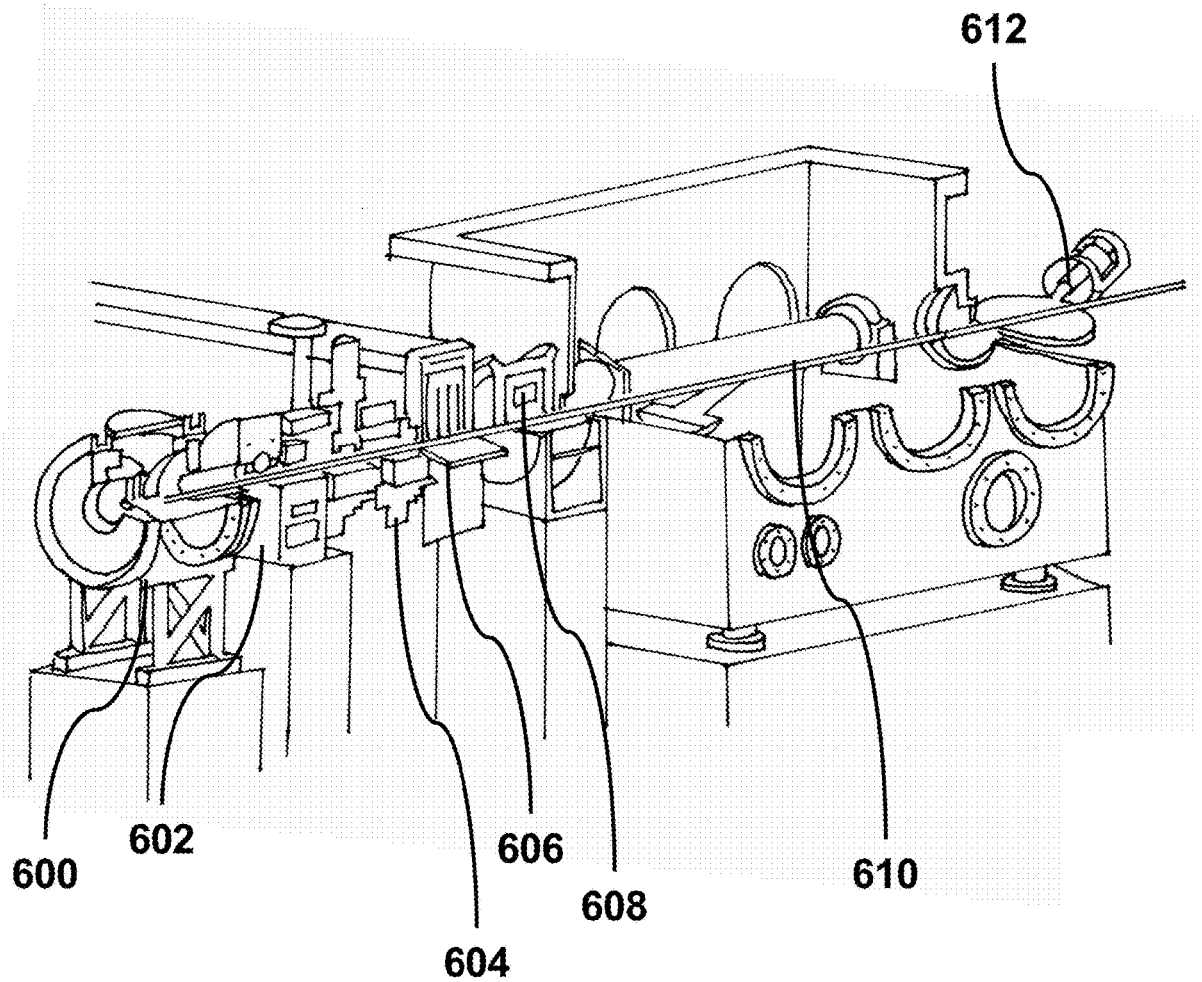
FIG. 6 is a 3D rendering of a realization of the UCES-based EUV ICS source, according to an embodiment of the invention. From left to right: (1) grating-MOT-based UCES; (2) RF compression cavity; (3) steering coils; (4) X-band accelerator section; (5) focusing magnetic coil; (6) interaction point: electron beam (green) collides with laser beam (blue), generating a soft X-ray beam (purple); (7) electron beam dump.

In FIG. 6 a 3D rendering is shown of an embodiment of a UCES-based ICS setup. The main components are a grating-MOT-based UCES 600, an RF compression cavity 602 and an X-band accelerator section 606. The electron bunches are focused with a magnetic coil 608 in the interaction point 610, where the electron beam collides with the laser beam, generating a soft X-ray beam. The device may also include a beam dump 612.

Grating-MOT-Based UCES

Figure 7:
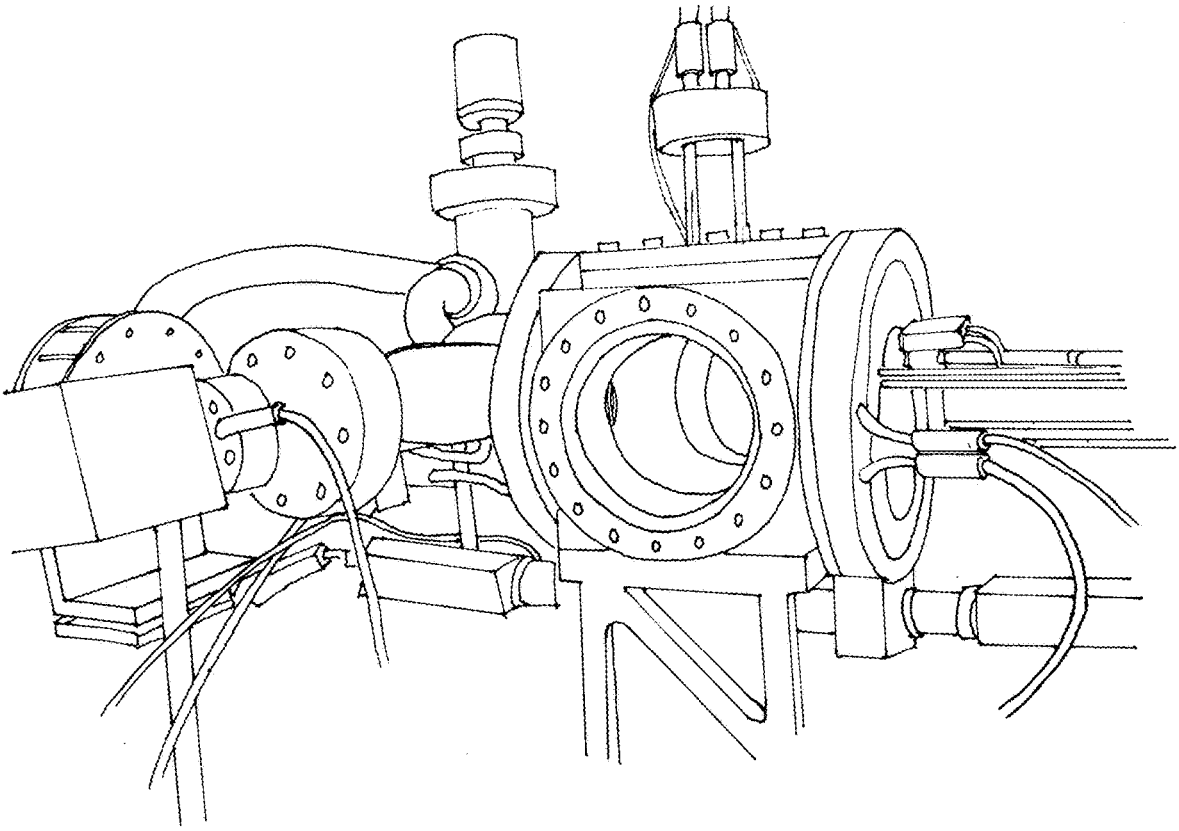
FIG. 7 is a photograph of a vacuum chamber with grating-MOT-based UCES inside, currently operational in the TU/e CQT lab, according to an embodiment of the invention. The trapping and cooling laser beams enter the vacuum chamber though an optical fiber from the right. The quadrupolar magnetic field of the MOT is created by the two external (yellow) coils. 100 CF vacuum windows allow maximum access for the excitation and ionization lasers. The accelerated ultracold electron bunches are injected into the beamline to the left.

In one embodiment, a laser-cooled and trapped cloud of rubidium atoms is created using a so-called 'grating Magneto Optical Trap', a technique[15] that allows a very compact design and turn-key operation, with minimal alignment of trapping and cooling lasers and maximal access for the excitation and ionization laser beams. FIG. 7 shows the vacuum chamber with a grating-MOT-based UCES inside [16]. The rubidium gas is trapped between two flat electrodes, comprising an electrostatic accelerator which extracts the electrons after ionization and accelerates them to −10 keV.

For the ICS setup, a dedicated grating-MOT-based UCES is used, specifically designed for achieving high atom densities in the MOT. An Optical Parametric Amplifier (OPA), fed by an amplified Ti:sapphire laser provides the tunable femtosecond 480 nm ionization laser pulses. Ever lower electron source temperatures may be obtained by appropriate selection of the bandwidth and the temporal profile of the ionization laser pulse.

RF Compression Cavity

Figure 8:
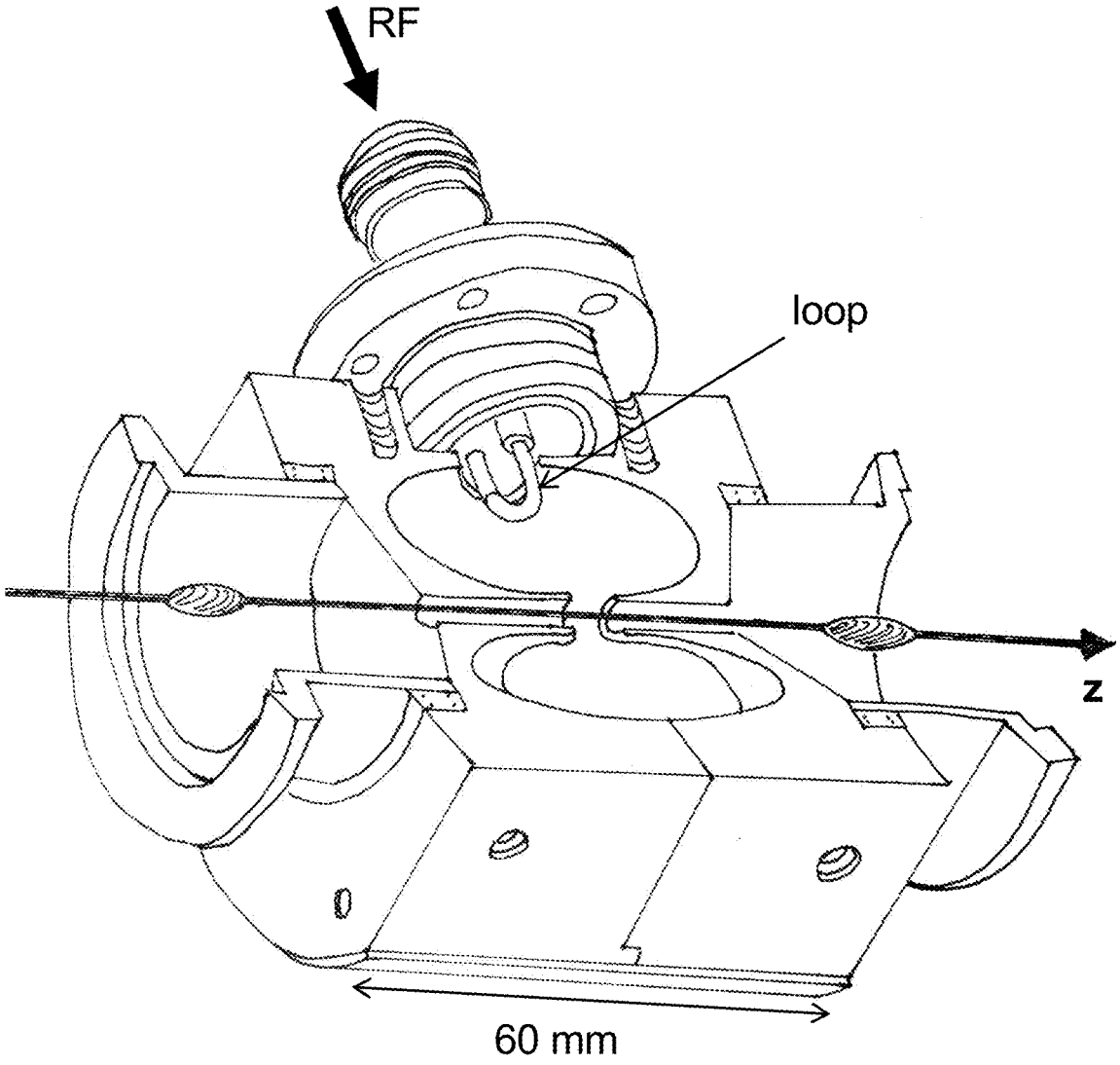
FIG. 8 is a 3D rendering of a 3 GHz RF compression cavity developed in the TU/e CQT group for single-shot UED, according to an embodiment of the invention. Using this cavity, the recording of high quality diffraction patterns with 100 keV electrons in a single 100 fs shot was demonstrated for the first time [12].

The electron bunches are compressed by velocity bunching, employing a 3 GHz resonant RF cavity in $TM_{010}$ mode, similar to those used for single-shot, 100 fs Ultrafast Electron Diffraction [11-13]. FIG. 8 shows a design drawing of the cavity, which is optimized for low power consumption, requiring less than 100 W RF power and thus only a modest solid-state RF amplifier.

The RF compression cavity is very robust and reliable and has been sold by AccTec BV to many groups worldwide over the past few years. Synchronization of the compressed electron bunch with the ICS interaction laser pulse is accomplished by synchronization of the RF phase with the laser pulse [17].

X-Band Accelerating Section

Preferred embodiments use a very compact X-band accelerator structure operating at 12 GHz. Because of the high accelerating fields in the X-band accelerators, typically >50 MV/m, only a few X-band cells, and ~10 cm of accelerator structure is sufficient to reach 1-2 MeV electron beam energies for generating EUV radiation by ICS. By injecting the bunches at the proper RF phase, acceleration could be combined with compression by velocity bunching in the X-band structure. However, we choose to separate compression and acceleration, as the RF bunch compression method is proven technology, allowing bunch compression to be controlled and optimized independently.

Generation of EUV Radiation

To maximize the EUV photon flux, a powerful, industrial pulsed sub-ps laser is preferably used to generate the laser beam that collides with the electron bunches in the interaction point. At present the most powerful turn-key systems are glass lasers providing 200 mJ, 1024 nm, sub-ps pulses at 1 kHz rep rate [18]. These expensive lasers are ideal for achieving a reliable high EUV photon yield. The $2^{nd}$ harmonic (512 nm) is preferred, which can be generated with at least 50% efficiency. As can be seen in FIG. 2, the choice of the interaction laser wavelength is a trade-off between photon flux (more EUV photons at longer wavelength) and required emittance (longer wavelengths require smaller emittance).

The generated EUV beam may be characterized and optimized in terms of EUV wavelength, bandwidth, angular spread, photon flux, coherence and brilliance.

Following is an overview of the method of operating the device.

Step 1

Modulate the excited rubidium gas in the z direction (in the $5^2P_{3/2}$ state) using two counterpropagating 780 nm laser beams that produce a standing wave. The excited gas will be spatially modulated with a period of $\lambda_{mod}$=390 nm.

Step 2

The excited rubidium beamlets are ionized using an ultrafast ionization laser (<1 picosecond) with an optical wavelength tuned close to the ionization threshold, for example, a blue ultrafast ionization laser. In this way we create a micro-bunched electron beam with a modulation period determined by the standing wave $\lambda_{mod}$=390 nm. Additionally, due to the near-threshold photoionization the electrons have an ultra-low momentum spread which results in a beam emittance that is smaller than 1 nm rad. This creates a fully transverse coherent X-ray pulse.

In order to generate fully transverse coherent x-ray radiation by ICS, high quality electron beams are used with normalized emittances preferably below 1 nm rad. The ultra-cold electron source is used to deliver high-charge electron bunches of such a quality.

Step 3

The rubidium atoms are ionized in an electrostatic acceleration field which accelerates the electrons created inside the UCES to an energy of a few tens of keV. Since the electrons that are ionized at a position further away from the aperture in the anode are accelerated to higher kinetic energy than the ones initially closer to the anode, the electron pulse acquires a negative velocity chirp after exiting the DC acceleration field. As a result, after extraction the electron pulse will self-compress. After the self-compression point, the pulse will automatically acquire a positive velocity chirp and therefore stretch again. Subsequently, using an RF cavity operated in $TM_{010}$ mode, the front of the electron pulse is decelerated while the back is accelerated, resulting in an electron pulse with again a negative velocity chirp.

Step 4

The negatively chirped picosecond electron pulse is RF accelerated to a few MeV and is simultaneously compressed by two orders of magnitude at the interaction point. This is due to the negative chirp acquired. It does not matter in which order the compression and the acceleration take place. The compression and the acceleration can also be realized simultaneously in a single RF accelerator.

As a result, the initial modulation period $\lambda_{mod}$=390 nm is shrunk by the same two orders of magnitude. The modulation period $\lambda_{mod}$=390 nm of the electron beam is now equal to the wavelength $\lambda$ of the soft x-ray pulse that is generated in the interaction point.

As a result, the generated soft X-ray beam will be fully longitudinal coherent. In addition, the radiation generated by the individual micro bunches will add up coherently so that the intensity will be boosted by an amount proportional to the number of the electrons in the bunch. This boosts the intensity to intensities comparable to that of SLSs and XFELs.

Simultaneously, the ultra-low electron emittance makes sure that the electron beam divergence in the interaction point is smaller than that of a diffraction limited soft X-ray beam; this guarantees the production of a fully spatially coherent soft X-ray beam.

Embodiments of the invention provide a state-of-the-art method that can generate narrowband (soft) X-ray beams which are fully coherent and have super-radiant intensity, realizing a table-top Compton soft X-ray free Electron Laser. The entire setup can be constructed with a footprint smaller than 3 meters.

REFERENCES

[1] Private communication, NXP, Eindhoven, N L

[2] B. J. Claessens, M. P. Reijnders, G. Taban, O. J. Luiten, and E. J. D. Vredenbregt, *Cold electron and ion beams generated from trapped atoms*, Phys. Plasmas 14, 093101 (2007).

[3] G. Taban, M. P. Reijnders, B. Fleskens, S. B. van der Geer, O. J. Luiten, and E. J. D. Vredenbregt, *Ultracold electron source for single-shot diffraction studies*, EPL 91, 46004 (2010).

[4] W. J. Engelen, M. A. van der Heijden, D. J. Bakker, E. J. D. Vredenbregt, and O. J. Luiten, *High-coherence electron bunches produced by femtosecond photoionization*, Nature Comm. 4, 1693 (2013).

[5] A. J. McCulloch, d. V. Sheludko, M. Junker and R. E. Scholten, *High-coherence picosecond electron bunches from cold atoms*, Nature Comm. 4, 1692 (2013).

[6] M. W. van Mourik, W. J. Engelen, E. J. D. Vredenbregt, and O. J. Luiten, *Ultrafast electron diffraction using an ultracold source*, Structural Dynamics 1, 034302 (2014); R. mark Wilson, Physics Today 67, 7, 12 (2014).

[7] O. J. Luiten, *Taking snapshots of atomic motion using electrons*, EPN 46/2, 21 (2015).

[8] A. J. McCulloch, D. V. Sheludko, S. D. Saliba, S. C. Bell, M. Junker, K. A. Nugent and R. E. Scholten, *Arbitrarily shaped high-coherence electron bunches from cold atoms*, Nature Phys. 7, 785 (2011).

[9] D. C. Nguyen and B. E. Carlsten, *Amplified coherent emission from electron beams prebunched in a masked chicane*, Nucl. Instr. And Meth. In Phys. Res. A 375, 597 (1996).

[10] E. A. Nanni, W. S. Graves, and D. E. Moncton, *Nanomodulated electron beams via electron diffraction and emittance exchange for coherent x-ray generation*, Phys. Rev. Accel. Beams 21, 014401 (2018).

[11] T. van Oudheusden, E. F. de Jong, B. J. Siwick, S. B. van der Geer, W. P. E. M. Op 't Root, and O. J. Luiten, *Electron source concept for single-shot sub-*100 *fs electron diffraction in the* 100 *keV range,* J. Appl. Phys. 102, 093501 (2007).

[12] T. van Oudheusden, P. L. E. M. Pasmans, S. B. van der Geer, M. J. de Loos, M. J. van der Wiel, and O. J. Luiten, *Compression of sub-relativistic space-charge-dominated*

*electron bunches for single-shot femtosecond electron diffraction*, Phys. Rev. Lett. 105, 264801 (2010).

[13] T. van Oudheusden, PhD thesis Eindhoven University of Technology 2010; P. L. E. M. Pasmans, PhD thesis, Eindhoven University of Technology 2014.

[14] http://www.pulsar.nl/gpt/

[15] C. C. Nshii, M. Vangeleyn, J. P. Cotter, P. F. Griffin, E. A. Hinds, C. N. Ironside, P. See, A. G. Sinclair, E. Riis, and A. S. Arnold, *A surface-patterned chip as a strong source of ultracold atoms for quantum technologies,* Nature Nanotechnology 8, 321 EP (2013).

[16] J. G. H. Franssen, M. A. W. van Ninhuijs, and O. J. Luiten, *Compact ultracold electron source based on a grating magneto optical trap*, ArXiv

[17] G. J. H. Brussaard, A. Lassise, P. L. E. M. Pasmans, P. H. A. Mutsaers, M. J. van der Wiel, and O. J. Luiten, *Direct measurement of synchronization between femtosecond laser pulses and a 3 GHz radio frequency electric field inside a resonant cavity*, Appl. Phys. Lett. 103, 141105 (2013).

[18] https://www.trumpf-scientific-lasers.com/en_INT/products/dira-series/

[19] W. Knulst, O. J. Luiten, M. J. van der Wiel, and J. Verhoeven, *Observation of narrow-band Si L-edge Cherenkov radiation generated by 5 MeV electrons,* Appl. Phys. Lett. 79, 2999 (2001).

[20] W. Knulst, M. J. van der Wiel, O. J. Luiten, and J. Verhoeven, *High-brightness, narrowband, and compact soft x-ray Cherenkov sources in the water window*, Appl. Phys. Lett. 83, 4050 (2003).

[21] http://www.andor.com/scientific-cameras/high-energy-detection/ikon-m-sy

J. Miao, T. Ishikawa, I. K. Robinson, and M. M. Murnane, *Beyond crystallography: diffractive imaging using coherent X-ray light sources*, Science 348, 530 (2015).

The invention claimed is:

1. A device for generating soft x-rays, the device comprising:

an electron source configured to generate an electron beam comprising electron micro-bunches;

an electron accelerator configured to accelerate the electron micro-bunches from the electron source; and a laser configured to generate a laser beam colliding with the accelerated electron micro-bunches in a counter-propagating direction to generate the soft x-rays;

wherein the electron source comprises:

a magneto-optical trap configured to produce an ultracold atomic gas;

two counterpropagating excitation laser beams configured to produce a standing wave for inducing a periodic spatial modulation of the ultracold atomic gas along a beam propagation direction;

an ionization laser configured to induce photo-ionization of the ultracold atomic gas.

2. The device of claim 1 wherein the electron accelerator comprises an RF compression cavity and X-band accelerator to simultaneously compress and accelerate the electron micro-bunches.

3. The device of claim 1 wherein the electron accelerator comprises steering coils and a focusing magnetic coil.

4. The device of claim 1 wherein the electron accelerator comprises an RF compression cavity configured to operate in $TM_{010}$ mode.

5. The device of claim 1 wherein the electron source comprises a DC plate configured to produce a DC acceleration field to extract the electron micro-bunches from the electron source.

6. A method for generating soft x-rays, the method comprising:

generating by an electron source an electron beam comprising electron micro-bunches;

accelerating by an electron accelerator the electron micro-bunches from the electron source; and colliding a laser beam with the accelerated electron micro-bunches in a counter-propagating direction to generate the soft x-rays;

wherein generating the electron beam comprising electron micro-bunches comprises:

producing an ultracold atomic gas by a magneto-optical trap;

producing a standing optical wave to induce a periodic spatial modulation of the ultracold atomic gas along a beam propagation direction;

inducing photo-ionization of the ultracold atomic gas.

7. The method of claim 6 wherein accelerating the electron micro-bunches comprises compressing the electron micro-bunches with an RF compression cavity and simultaneously accelerating the electron micro-bunches with an X-band accelerator.

8. The method of claim 6 wherein accelerating the electron micro-bunches comprises compressing the electron micro-bunches with an RF compression cavity operating in $TM_{010}$ mode.

9. The method of claim 6 wherein generating the electron beam comprises extracting the electron micro-bunches from the electron source using a DC acceleration field.

10. The method of claim 6 wherein producing a standing optical wave to induce a periodic spatial modulation of the ultracold atomic gas along a beam propagation direction comprises inducing double-modulation.

* * * * *